US007148440B2

(12) United States Patent
Gjerde

(10) Patent No.: US 7,148,440 B2
(45) Date of Patent: Dec. 12, 2006

(54) STACKABLE SWITCH

(75) Inventor: Richard D. Gjerde, Braceville, IL (US)

(73) Assignee: Illinois Tool Works, Inc, Glenview, IL (US)

( * ) Notice: Subject to any disclaimer, the term of this patent is extended or adjusted under 35 U.S.C. 154(b) by 0 days.

(21) Appl. No.: 10/928,413

(22) Filed: Aug. 27, 2004

(65) Prior Publication Data

US 2006/0042925 A1 Mar. 2, 2006

(51) Int. Cl.
*H01H 1/16* (2006.01)

(52) U.S. Cl. ..... 200/569; 200/568

(58) Field of Classification Search ..... 200/568, 200/569, 558, 572, 293–296, 239, 246–250, 200/11 R–11 K, 17 R, 18, 50.33, 50.34, 200/330, 331, 336

See application file for complete search history.

(56) References Cited

U.S. PATENT DOCUMENTS 2,697,156 A * 12/1954 Hortman, Jr. et al. ..... 200/569
3,800,249 A * 3/1974 Bury ..... 335/2
3,968,338 A * 7/1976 Zdanys ..... 200/431
4,025,738 A * 5/1977 Erwin et al. ..... 200/6 B
4,133,990 A * 1/1979 Wanner et al. ..... 200/6 B
4,152,755 A * 5/1979 Trosper et al. ..... 362/158
4,308,433 A * 12/1981 Edwards, Jr. ..... 200/5 R
4,324,956 A * 4/1982 Sakakino et al. ..... 200/16 R
4,380,019 A * 4/1983 Steinberger et al. ..... 347/7
4,400,597 A * 8/1983 Bruder et al. ..... 200/6 B
4,467,160 A * 8/1984 Murmann et al. ..... 200/536
4,625,084 A * 11/1986 Fowler et al. ..... 200/11 DA
4,816,623 A * 3/1989 Huang ..... 200/11 R
4,861,949 A * 8/1989 Bortolloni et al. ..... 200/5 R
4,945,195 A * 7/1990 Ipcinski ..... 200/6 B
5,059,754 A * 10/1991 Kaichi et al. ..... 200/332.1
5,315,077 A * 5/1994 Simon et al. ..... 200/11 R
5,594,220 A * 1/1997 Hackbarth et al. ..... 200/6 B
5,650,601 A * 7/1997 Krueger et al. ..... 200/61.86
5,687,836 A 11/1997 Gjerde ..... 200/569
5,854,456 A * 12/1998 Lee-ven ..... 200/11 TW
6,501,040 B1 * 12/2002 Hall et al. ..... 200/543
6,525,280 B1 * 2/2003 Chan et al. ..... 200/6 A
6,590,169 B1 * 7/2003 Martinez ..... 200/17 R
6,791,041 B1 * 9/2004 Chen et al. ..... 200/51 R
6,864,439 B1 * 3/2005 Chen ..... 200/6 BB
2002/0023828 A1 * 2/2002 Chan et al. ..... 200/6 A
2003/0075423 A1 * 4/2003 Martinez ..... 200/17 R
2005/0040018 A1 * 2/2005 Gotoh ..... 200/17 R

* cited by examiner

*Primary Examiner*—Michael Friedhofer
*Assistant Examiner*—Lisa Klaus
(74) *Attorney, Agent, or Firm*—Mark W. Croll; Paul F. Donovan

(57) ABSTRACT

A stackable switch assembly includes a base switch housing having switch components therein, an intermediate switch housing having second switch components therein, with the intermediate switch housing mechanically engaged with the base switch housing, and a cover mechanically engaged with the intermediate switch housing. Multiple intermediate switch housings can be used between the base switch housing and the cover.

20 Claims, 3 Drawing Sheets

STACKABLE SWITCH

FIELD OF THE INVENTION

The present invention relates generally to electrical switch assemblies that are actuated by rotatable members, and, more particularly, to switches used in wiring harnesses, such as on appliances, including ignition systems for gas-fired appliances.

BACKGROUND OF THE INVENTION

Electrical switches having rotatable actuators are used in a variety of applications. For example, it is known to use such switches in gas fueled cooking appliances. An electrical switch assembly is coupled to the rotatable valve stem of the gas valve, to control burner ignition circuitry. When the gas valve stem is rotated to place the valve in the open position and commence gas flow, the burner ignition electrical circuitry is energized to ignite the gas stream at the burner. In this way, stand-by pilot lights are not required, and gas ignition occurs simultaneously with opening the gas valve and commencing the flow of gas. Fuel is not wasted keeping a pilot light burner. Considerable fuel savings can be experienced, particularly in appliances that are used infrequently, with prolonged periods of nonuse. Pilot-less ignition systems conserve fuel and thereby improve appliance efficiency.

U.S. Pat. No. 5,687,836 entitled "ELECTRICAL SWITCH ASSEMBLY ACTUATABLE BY A ROTATABLE MEMBER", issued Nov. 18, 1997, describes one such electrical switch assembly having utility for gas fired appliances. The switch assembly disclosed therein can be connected in a parallel electrical circuit configuration. While providing many advantages, the switch assembly disclosed therein can be used only for a single circuit, and each switch function in each circuit requires a separate switch.

To improve appliance safety and enhance customer convenience, it is sometimes desirable to include multiple switching functions upon actuation or rotation of a single actuator. A variety of indicator lights to indicate status may be actuated with the primary function, or may be oppositely actuated. For example, it may be desirable to illuminate a "burner on" indicator together with actuation of the ignition circuitry when a gas valve is opened. An electric circuit to indicate ignition failure can be energized upon opening the gas valve, to be illuminated if ignition does not occur within a specific period of time. It may be desirable for various other safety and/or convenience features that are electrically operated to be actuated or de-actuated upon opening the gas valve.

As more and more individual switches for additional functions are combined with a single actuator, the actuator becomes unduly long and the switching mechanisms complex. Individual switches can be electrically connected, one to another, with only one controlled by the actuator and others electrically controlled therefrom. However the wiring harness becomes unduly large and complex, and requires significant space for installation. In appliances, it is desirable to minimize space requirements for controls and the like, to maximize area available for appliance functions, for example oven interior space, while minimizing overall appliance size.

There is a need in the art to provide a compact switching arrangement for multiple switching functions actuated by a single actuator to keep wiring harness assemblies compact.

SUMMARY OF THE INVENTION

The present invention provides a stackable switch assembly having a base switch housing and a cover, with one or more intermediate switch housings fitted between the base switch housing and the cover. The base switch housing and the intermediate switch housings each contain switches actuated by a single actuator extending therethrough.

In one aspect thereof, the present invention provides a multifunction switch assembly with a base switch housing having first switch disposed therein and at least one intermediate switch housing having an other switch disposed therein. The intermediate switch housing is adapted for mechanical engagement with the base switch housing. A cover is adapted for selective attachment to and engagement with the base switch housing and the intermediate switch housing. An actuator is disposed within the base switch housing and the intermediate switch housing for operating the first switch and the other switch.

In another aspect thereof, the present invention provides a rotatable switch assembly with a base housing having a base surface topography configured to hold switch components, to receive a rotatable actuator for operating the switch components and to receive an independent structure to cover the components. A cover has a cover surface topography configured to mechanically engage the base surface topography. An intermediate housing has on one side thereof a first surface topography substantially similar to the cover surface topography for mechanically engaging the base housing. An opposite side of the intermediate housing has a second surface topography substantially similar to the base surface topography for holding second switch components, for receiving the rotatable actuator for operating the second switch components and for mechanically engaging the cover. The first side of the intermediate housing is engaged with the base housing and the opposite side of the intermediate housing is engaged with the cover.

In still another aspect thereof, the present invention provides a switch assembly with a cover having a side with a first topography, and a base housing having a side with a second topography for holding switch components. The first and second topographies are configured to mechanically engage one with the other to secure the cover and the base to each other. An intermediate housing has a first surface with the first topography and an opposite surface with the second topography. The first surface of the intermediate housing is engaged with the base housing and the second surface of the intermediate housing is engaged with the cover.

An advantage of the present invention is providing a multi-function, multi-switch arrangement that is compact.

Another advantage of the present invention is providing multiple switches actuated by a single actuator.

Still another advantage of the present invention is providing multiple switches that require minimal space.

Still another advantage of the present invention is providing a multi-function switch assembly that can be expanded as required for additional switching functions.

Other features and advantages of the invention will become apparent to those skilled in the art upon review of the following detailed description, claims and drawings in which like numerals are used to designate like features.

Figure 1:
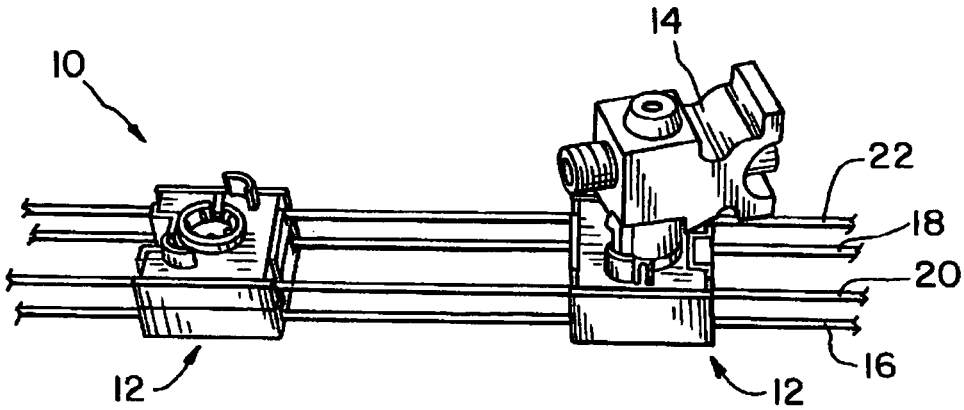
FIG. 1 is a perspective view of a wiring harness having stackable switches in accordance with the present invention.
Figure 4:
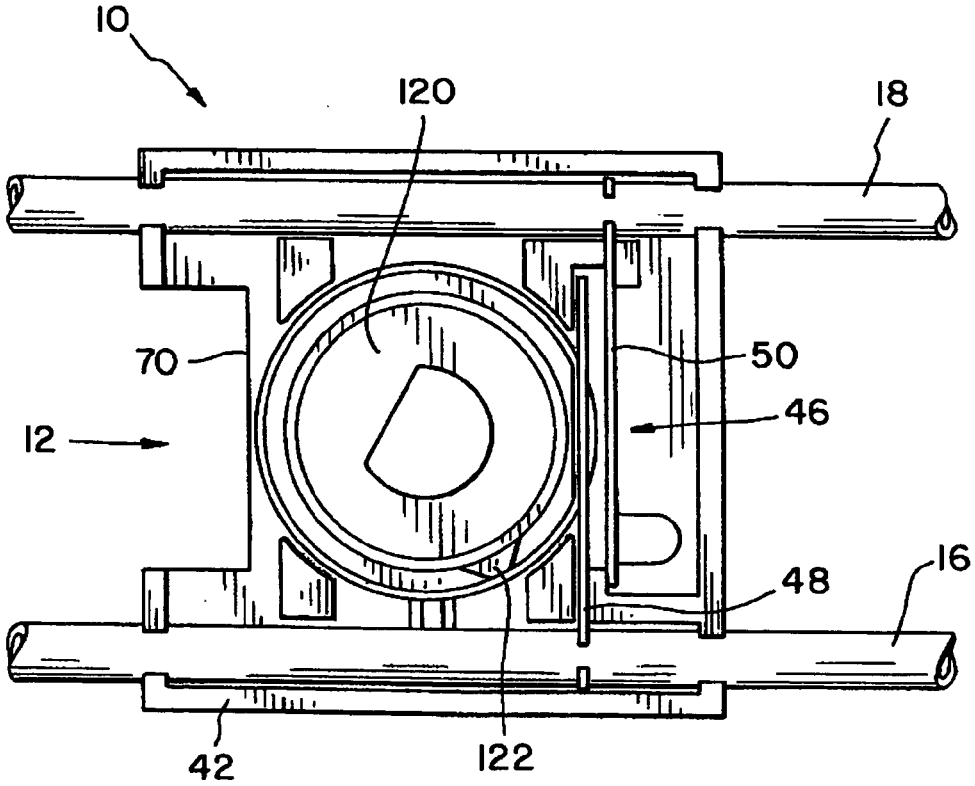
FIG. 4 is a top view of one of the switches in the switch assembly.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, numeral 10 designates a wiring harness having stackable switch assemblies 12 in accordance with the present invention Two switch assemblies 12 are illustrated in FIG. 1 on wiring harness 10; however, as those skilled in the art will understand readily, a single switch assembly 12 may be used where appropriate, and three or more switch assemblies 12 also may be used when required. The present invention works well with a variety of actuators and, as illustrated in FIG. 1, switch assembly 12 works well in an appliance such as a kitchen range having a gas fired burner for which a gas valve 14 is provided. One such gas valve 14 is shown for one switch assembly 12 in FIG. 1. Gas valve 14 is operatively associated with switch assembly 12, as will be described in further detail hereinafter. The other switch assembly 12 can be associated with another gas valve 14 (not shown), or with another form of actuator (not shown).

Wiring harness 10 further includes a plurality of electrical conductors 16, 18, 20 and 22 connected to switch assemblies 12. As will be described further hereinafter, wiring harness 10 may have more or fewer conductors than the four conductors 16, 18, 20 and 22 shown in FIG. 1 as required for the particular configurations of switch assemblies 12 being used.

Figure 2:
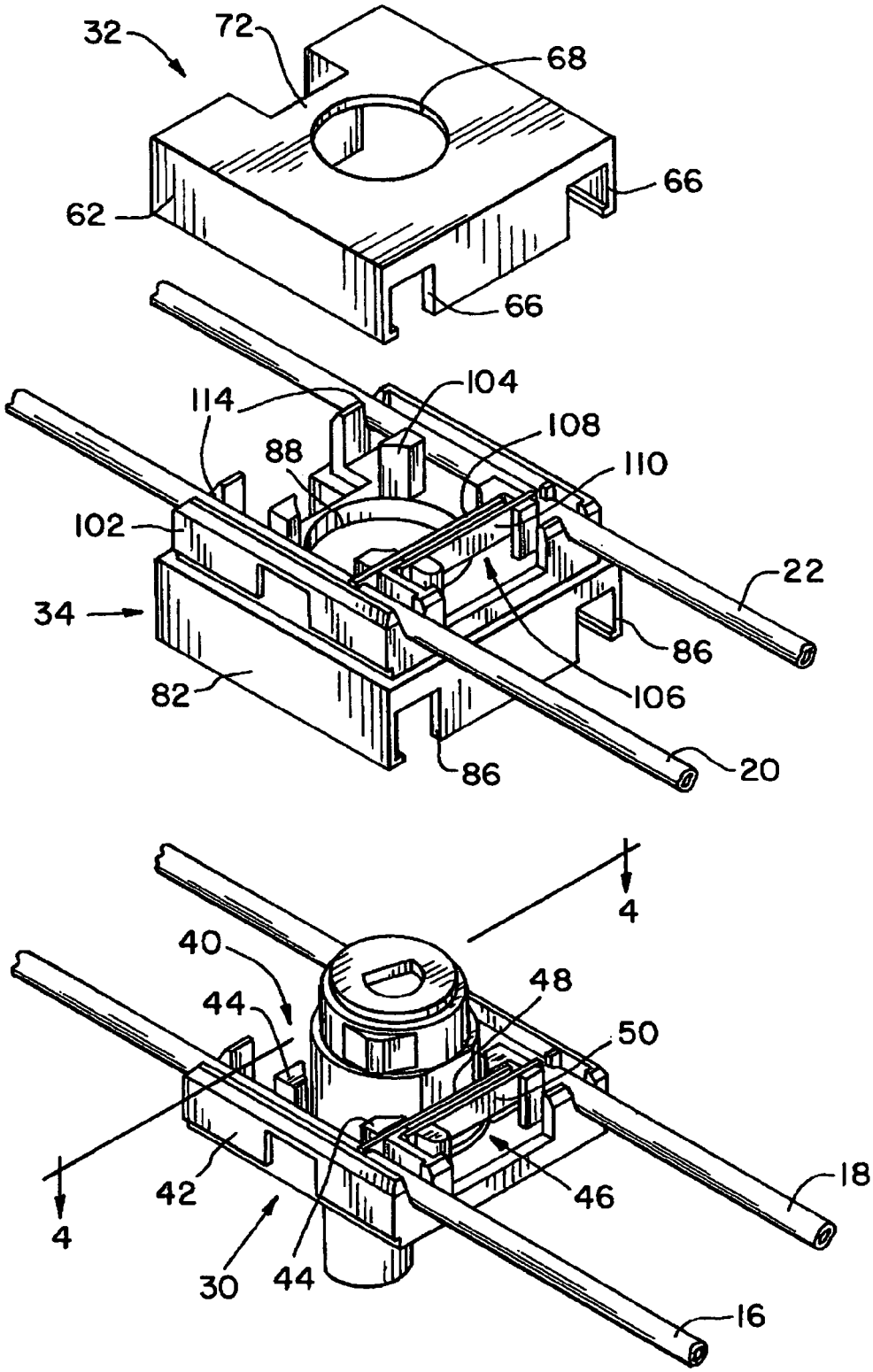
FIG. 2 is an exploded view of one of the stackable switch assemblies of the present invention.
Figure 3:
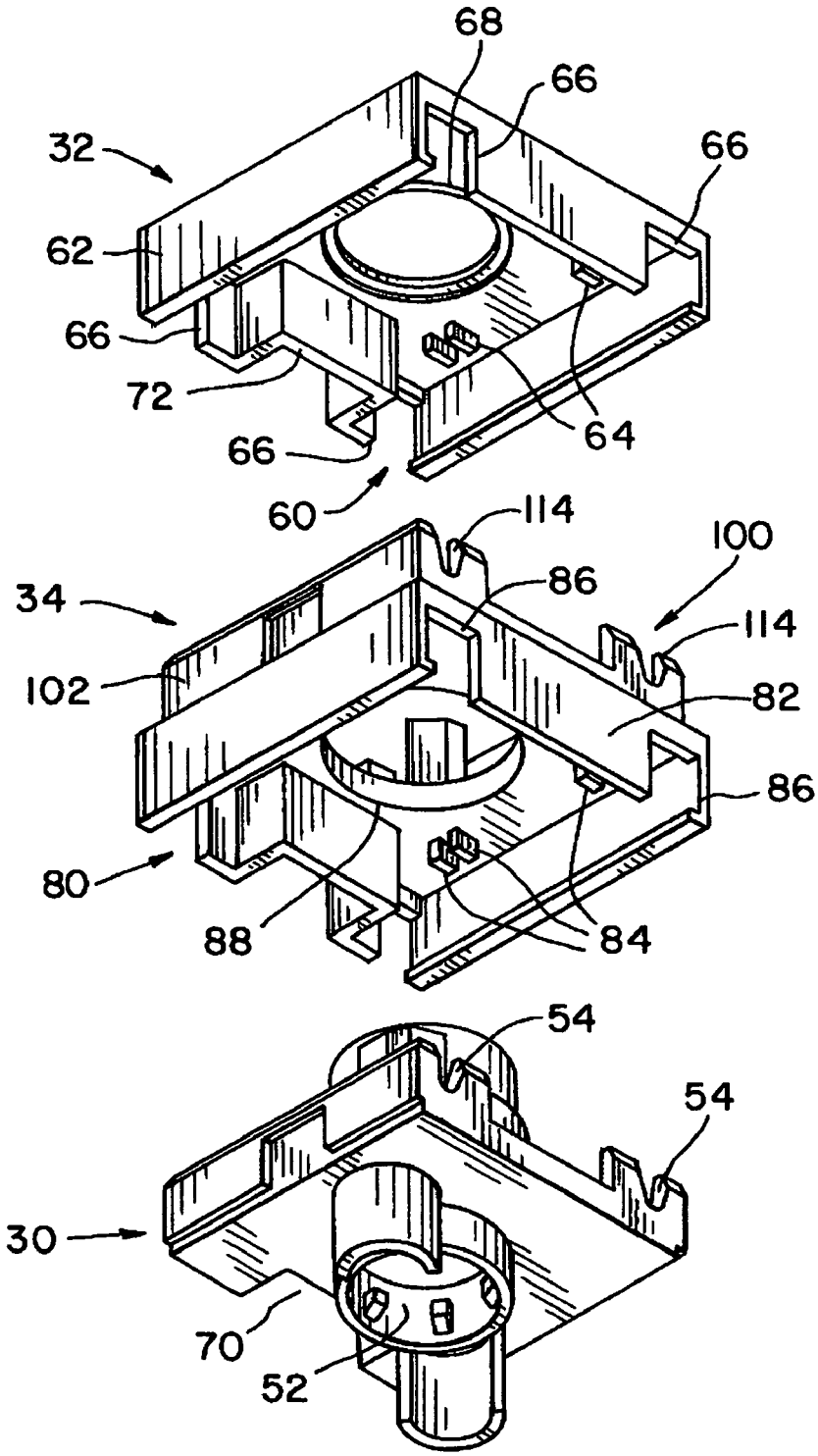
FIG. 3 is an exploded view of the stackable switch mechanism shown in FIG. 2, having the wires removed and shown from a different angle.

With reference now to the exploded views of FIGS. 2 and 3, stackable switch assembly 12 includes a bottom or base housing 30, a cover 32 and an intermediate housing 34 disposed between base housing 30 and cover 32. In assembled configuration, base housing 30, intermediate housing 34 and cover 32 are snap-fit together in mechanically interlocking engagement. The interconnection between components can be made watertight, or substantially watertight, so that cooking fluids and other liquids can not seep through the connection points therebetween when stackable switch assembly 12 is used on a wiring harness 10 for stoves or other kitchen appliances, or in equipment that may be exposed to liquids and moisture.

Base housing 30 includes a general base surface topography 40 having a base peripheral skirt 42 and including various posts 44 and other shaped projections for holding a first switch 46 and for securing conductors 16 and 18 extending through base housing 30. Switch 46 includes a pair of resilient blades 48, 50 disposed in spaced relation within base housing 30. Blade 48 is electrically connected to conductor 16, and blade 50 is electrically connected to conductor 18. Deflection of blade 48 towards blade 50 sufficient to cause contact between blades 48 and 50 causes electrical connection between conductor 16 and conductor 18 through switch 46. A substantially central aperture 52 is provided through base housing 30. In the exemplary embodiment, base peripheral skirt 42 includes notches 54 for receiving conductors 16 and 18. Those skilled in the art will understand readily that the precise configuration of surface topography 40 will vary depending upon the specific type of switch 46 being used as well as the type and size of conductors 16 and 18 connected to switch 46.

Cover 32 includes a cover surface topography 60 having a cover peripheral skirt 62 and various projections 64 to aid in the positioning and retention of conductors 16, 18 and components of switch 46 held therebeneath. Peripheral skirt 62 of cover surface topography 60 includes notches 66 for conductors extended therethrough. Cover 32 is provided with a central aperture 68 substantially aligned with aperture 52 in the assembled switch assembly 12. Cover 32 and specifically surface topography 60 thereof, is configured and arranged to complement base housing 30 and specifically base surface topography 40 thereof. Cover surface topography 60 and base surface topography 40 engage one another to mechanically interlock and secure base 30 and cover 32 together. Conductors 16 and 18 and components of switch 46 are held securely in position after assembly.

For a single switch installation, two conductors 16 and 18 are passed through base housing 30 and blades 48 and 50 of switch 46 are electrically connected to conductors 16 and 18, respectively. Cover 32 is placed in interlocking mechanical engagement with base 30 through the cooperating surface topographies 40 and 60. Peripheral skirt 42 of base housing 30 fits substantially within peripheral skirt 62 of cover surface topography 60. Cooperating recesses 70, 72 can be provided in base 30 and cover 32, respectively, for proper orientation and alignment of base 30 and cover 32.

Intermediate housing 34 is provided between base housing 30 and cover 32 when multiple switching functions are to be performed. Intermediate housing 34 includes a first surface topography 80 thereof substantially similar to cover surface topography 60. Thus, first surface topography 80 includes a first surface peripheral skirt 82 and various projections 84 to aid in the positioning and retention of conductors 16, 18 and components of switch 46 held therebeneath. Peripheral skirt 82 of first surface topography 80 includes notches 86 for conductors extended therethrough. Intermediate hosing 34 is provided with a central aperture 88 substantially aligned with aperture 52 in the assembled switch assembly 12. Intermediate housing 34, and specifically first surface topography 80 thereof, is configured and arranged to complement base housing 30 and specifically base surface topography 40 thereof. First surface topography 80 and base surface topography 40 engage one another to mechanically interlock and secure base 30 and intermediate housing 34 together. Conductors 16 and 18 and components of switch 46 are held securely in position after assembly.

Intermediate housing 34 further includes a second surface topography 100 substantially similar to base housing surface topography 40. Thus, second surface topography 100 includes a second surface peripheral skirt 102 and including various posts 104 and other shaped projections for holding a second switch 106 and for securing conductors 20 and 22 extending through second intermediate housing 34. Second switch 106 includes a pair of resilient blades 108, 110 disposed in spaced relation within intermediate housing 34. Blade 108 is electrically connected to conductor 20, and blade 110 is electrically connected to conductor 22. Deflection of blade 108 towards blade 110 sufficient to cause contact between blades 108 and 110 causes electrical connection between conductor 20 and conductor 22 through switch 106. In the exemplary embodiment, second surface peripheral skirt 102 includes notches 114 for receiving conductors 20 and 22. Those skilled in the art will understand readily that the precise configuration of second surface topography 100 will vary depending upon the specific type of switch 106 being used as well as the type and size of conductors 20 and 22 connected to switch 106.

Intermediate housing 34 can be mechanically engaged with each base housing 30 and cover 32. Intermediate housing 34 is placed in interlocking mechanical engagement with base 30 through the cooperating surface topographies 40 and 80. Peripheral skirt 42 of base housing 30 fits substantially within peripheral skirt 82 of first surface topography 80 on intermediate housing 34. Intermediate housing 34 is placed in interlocking mechanical engagement with cover 32 through the cooperating surface topographies 60 and 100. Peripheral skirt 102 on second surface topography 100 of intermediate housing 30 fits substantially within peripheral skirt 62 of cover 60. Thus, when multiple switching functions are to be performed, first and second switches 46 and 106 are positioned one above another within a compact switch assembly 12, and conductors 16, 18, 20 and 22 for switches 46 and 106 are neatly arranged and secured. With a single intermediate housing 34 between base housing 30 and cover 32, two switching functions can be performed in a compact, integral structure.

It should be understood by those skilled in the art that two or more intermediate housings 34 may be positioned one interconnected with the other between base housing 30 and cover 32. Thus, if three switching functions are to be performed, two intermediate housings 34 are used. Adjacent intermediate housings 34 are placed in interlocking mechanical engagement with each other through the cooperating first and second surface topographies 80 and 100 of each Peripheral skirt 102 of second surface topography 100 on one intermediate housing 34 will fit substantially within peripheral skirt 82 of first surface topography 80 on an adjacent intermediate housing 34. The cooperating first and second surface topographies 80, 100 of adjacent intermediate housings 34 position and secure the components of additional switches and the conductors therefor in a similar manner as described above for first switch 46, second switch 106 and conductors 16, 18, 20 and 22.

A rotatable actuator 120 is provided through the aligned apertures of base 30, cover 32 and the one or more intermediate housings 34 provided in switch assembly 12. Actuator 120 can be, for example, an attachment to or an extension of the valve stem for gas valve 14 of a gas-fired kitchen range or the like, so that switches 46 and 106 are operated in combination with changes made in opening or closing gas valve 14. Switch assembly 12 also can be independent of any associated device such as gas valve 14, in which case a knob (not shown) or other structure is provided on actuator 120, for rotating actuator 120.

Actuator 120 is provided with a cam or cams 122 such that rotation of actuator 120 causes one or more cam 122 to operate first switch 46 and second switch 106. In the arrangement shown in FIG. 2, with both first switch 46 and second switch 106 provided on the same side of actuator 120 switches 46 and 106 will be simultaneously opened or closed upon rotation of actuator 120. Those skilled in the art will readily understand that by repositioning one or the other of first switch 46 and second switch 106 rotation of actuator 120 can cause one switch 46, 106 to open while the other switch 46, 106 is closed. In this way, functions controlled by switches 46, 106 can be caused to occur together or to occur alternately to each other. The coordination of performance for multiple functions can be extended through three or more switch functions when two or more intermediate housings 34 are used between base housing 30 and cover 32.

The present invention provides a compact, well-organized structure for wiring harness 10. Conductors 16, 18, 20 and 22 are aligned, positioned and held by switch assembly 12. Multiple switching functions can be provided in a single interconnected structure that is compact and requires minimal space, thereby facilitating the use -of an increased number electrically controlled features in an appliance or device with minimal space for the wiring harness components.

Variations and modifications of the foregoing are within the scope of the present invention It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention The claims are to be construed to include alternative embodiments to the extent permitted by the prior art.

Various features of the invention are set forth in the following claims.

What is claimed is:

1. A multifunction switch assembly comprising:

a base switch housing having a first switch disposed therein, and including base switch housing surface structure;

at least one intermediate switch housing having an other switch disposed therein, said intermediate switch housing including intermediate switch housing surface structure that confronts and cooperates with said base switch housing surface structure to directly attach and mechanically engage said intermediate switch housing to said base switch housing;

a cover including cover surface structure for selective positioning in confrontation against, attachment to and engagement with said base switch housing surface structure and said intermediate switch housing surface structure; and an actuator disposed within said base switch housing and said intermediate switch housing for operating said first switch and said other switch.

2. The switch assembly of clam 1, at least one of said first switch and said other switch comprising a pair of resilient blades disposed in spaced relation within said base switch housing and said intermediate switch housing, and said actuator including a cam for deflecting one of said resilient blades into electrical contact with the other of said resilient blades.

3. The switch assembly of claim 2, said first switch and said other switch arranged in said base switch housing and said intermediate switch housing to be mutually closed and mutually opened upon movement of said cain.

4. The switch assembly of claim 2, said first switch and said other switch arranged in said base switch housing and said intermediate switch housing so that one of said first switch and said other switch is open and one closed upon movement of said cam.

5. The switch assembly of claim 1, said base switch housing, said intermediate switch housing and said cover having substantially aligned apertures, and said actuator being a rotatable actuator rotatably disposed in said apertures.

6. The switch assembly of claim 5, said first switch and said other switch each comprising a pair of resilient blades disposed in spaced relation within said base switch housing and said intermediate switch housing, and said actuator including a cam for deflecting one of said resilient blades into electrical contact with the other of said resilient blades in each said switch.

7. The switch assembly of claim 6, said first switch and said other switch arranged in said base and said intermediate housing to be mutually closed and mutually opened upon movement of said cam.

8. The switch assembly of claim 6, said first switch and said other switch arranged in said base and said intermediate housing to be oppositely closed and opened upon movement of said cam.

9. A rotatable switch assembly comprising:

a base housing having a base surface topography configured to hold switch components, to receive a rotatable actuator for operating the switch components and to confront, receive and mechanically engage an independent structure to cover said components;

a cover having a cover surface topography configured to confront, mechanically interlock with and engage said base surface topography; and an intermediate housing having on one side thereof a first surface topography substantially similar to said cover surface topography for confronting and mechanically engaging said base housing, and on an opposite side thereof a second surface topography substantially similar to said base surface topography for holding second switch components, for receiving the rotatable actuator for operating the second switch components and for confronting, mechanically engaging and interlocking with said cover, said first side of said intermediate housing confronting and being engaged with said base housing and said opposite side of said intermediate housing confronting and being engaged with said cover.

10. The switch assembly of claim 9, said base surface topography and said intermediate housing first surface topography each including peripheral skirts configured to fit one within the other.

11. The switch assembly of claim 9, said cover surface topography and said intermediate housing second surface topography each including peripheral skirts configured to fit one within the other.

12. The switch assembly of claim 11, said base surface topography and said intermediate housing first surface topography each including peripheral skirts configured to fit one within the other.

13. The switch assembly of claim 9, said base surface topography, said intermediate housing first and second surface topographies and said cover surface topography configured for confronting and mechanically engaging said base housing selectively with one of said intermediate housing and said cover, and for confronting and mechanically engaging said cover selectively with one of said base housing and said intermediate housing.

14. The switch assembly of claim 9, said base surface topography and said second surface topography configured to hold first and second switches arranged in said base and said intermediate housing to be mutually closed and mutually opened upon movement of said cam.

15. The switch assembly of claim 9, said base surface topography and said second surface topography configured to hold first and second switches arranged in said base and said intermediate housing to be oppositely closed and opened upon movement of said cam.

16. A switch assembly comprising:

a cover having a surface thereof with a first topography;

a base housing having a surface thereof with a second topography for holding switch components;

said first and second topographies confronting one another and configured to mechanically engage and interlock one with the other to secure said cover and said base to each other; and an intermediate housing having a first surface thereof with said first topography and an opposite surface thereof with said second topography, said first surface of said intermediate housing confronting and being engaged and mechanically interlocked with said base housing and said second surface of said intermediate housing fronting and being engaged and mechanically interlocked with said cover.

17. The switch assembly of claim 16, said first topography configured for holding electrical conductors connected to switch components.

18. The switch assembly of claim 16, said base housing, said cover and said intermediate housing having substantially aligned apertures, and a rotatable actuator disposed in said substantially aligned apertures.

19. The switch assembly of claim 16, said first topography and said second topography including peripheral skirts, one said peripheral skirt fitting substantially within the other said peripheral skirt.

20. The switch assembly of claim 19, said peripheral skirt of said second topography configured to fit within said peripheral skirt of said first topography.

* * * * *